US007584904B2

(12) United States Patent
Townsend

(10) Patent No.: US 7,584,904 B2
(45) **Date of Patent: *Sep. 8, 2009**

(54) SPRINKLER WITH VISCOUS HESITATOR

(75) Inventor: Michael Townsend, Waitsburg, WA (US)

(73) Assignee: Nelson Irrigation Corporation, Walla Walla, WA (US)

( * ) Notice: Subject to any disclaimer, the term of this patent is extended or adjusted under 35 U.S.C. 154(b) by 137 days.

This patent is subject to a terminal disclaimer.

(21) Appl. No.: 11/409,069

(22) Filed: Apr. 24, 2006

(65) Prior Publication Data

US 2007/0246560 A1 Oct. 25, 2007

(51) Int. Cl.
*B05B 3/04* (2006.01)

(52) U.S. Cl. ..... 239/222.17; 239/222.11

(58) Field of Classification Search ..... 239/214, 239/222.11, 222.17, 222.21, 223, 224, 252, 239/230–233
See application file for complete search history.

(56) References Cited

U.S. PATENT DOCUMENTS 3,727,842 A 4/1973 Ertsgaard et al.
4,375,513 A 3/1983 Debono et al.
4,836,449 A 6/1989 Hunter
4,836,450 A 6/1989 Hunter
5,192,024 A 3/1993 Blee
5,372,307 A 12/1994 Sesser
5,671,886 A 9/1997 Sesser
2008/0277489 A1 * 11/2008 Townsend ..... 239/7
2008/0277498 A1 * 11/2008 Townsend ..... 239/222.17

* cited by examiner

*Primary Examiner*—Christopher S Kim
(74) *Attorney, Agent, or Firm*—Nixon & Vanderhye. P.C.

(57) ABSTRACT

A sprinkler device incorporates a rotatable shaft having a cam, the cam having a radially outwardly projecting shaft lobe. A water distribution plate is supported on one end of the shaft and is adapted to be impinged upon by a stream emitted from a nozzle causing the water distribution plate and the shaft to rotate. A hesitator assembly is supported on an opposite end of the shaft, the assembly including a stationary housing having a sealed chamber at least partially filled with a viscous fluid. The shaft passes through the chamber, with the cam and shaft lobe located within said chamber. A rotor ring is located within the chamber in surrounding relationship to the cam, and the rotor ring has two or more inwardly projecting hesitator lobes movable into and out of a path of rotation of the shaft lobe, such that rotation of the shaft and water distribution plate is slowed during intervals when the shaft lobe engages and pushes past the one or more hesitator lobes.

7 Claims, 7 Drawing Sheets

SPRINKLER WITH VISCOUS HESITATOR

BACKGROUND OF THE INVENTION

This invention relates to rotary sprinklers and, more specifically, to a rotary sprinkler having a stream interrupter or "hesitator" that operates in either a random or controlled manner to achieve greater uniformity in the sprinkling pattern and/or to create unique and otherwise difficult-to-achieve pattern shapes.

Stream interrupters or stream diffusers per se are utilized for a variety of reasons and representative examples may be found in U.S. Pat. Nos. 5,192,024; 4,836,450; 4,836,449; 4,375,513; and 3,727,842.

One reason for providing stream interrupters or diffusers is to enhance the uniformity of the sprinkling pattern. When irrigating large areas, the various sprinklers are spaced as far apart as possible in order to minimize system costs. To achieve an even distribution of water at wide sprinkler spacings requires sprinklers that simultaneously throw the water a long distance and produce a pattern that "stacks up" evenly when overlapped with adjacent sprinkler patterns. These requirements are achieved to some degree with a single concentrated stream of water shooting at a relatively high trajectory angle (approximately 24° from horizontal), but streams of this type produce a non-uniform "donut pattern". Interrupting a single concentrated stream, by fanning some of it vertically downwardly, produces a more even pattern but also reduces the radius of throw.

Proposed solutions to the above problem may be found in commonly owned U.S. Pat. Nos. 5,372,307 and 5,671,886. The solutions disclosed in these patents involve intermittently interrupting the stream as it leaves a water distribution plate so that at times, the stream is undisturbed for maximum radius of throw, while at other times, it is fanned to even out the pattern. In both of the above-identified commonly owned patents, the rotational speed of the water distribution plate is slowed by a viscous fluid brake to achieve both maximum throw and maximum stream integrity.

There remains a need, however, for an even more efficient stream interrupter or diffuser configuration to achieve more uniform wetted pattern areas.

BRIEF SUMMARY OF THE INVENTION

One exemplary sprinkler incorporates a hesitating mechanism (or simply "hesitator" assembly) into a rotary sprinkler that causes a momentary reduction in speed of the water distribution plate. This momentary dwell, or slow-speed interval, alters the radius of throw of the sprinkler. In one exemplary embodiment, the hesitation or slow-speed interval occurs randomly, thus increasing the overall uniformity of the wetted pattern area. In this embodiment, a cam is fixed to the water distribution plate shaft, the cam (referred to herein as the "shaft cam") located in a sealed chamber containing a viscous fluid. Surrounding the cam is a rotor ring that "floats" within the chamber and that is formed with cam lobes (referred to herein as "the hesitator lobes") that are adapted to be engaged by the shaft cam, and more specifically, a shaft lobe on the shaft cam. In this regard, the rotor ring is free not only to rotate but also to move laterally or translate within the chamber. Thus, when a hesitator lobe is struck by the shaft lobe, the rotation of the shaft cam, shaft and water distribution plate slows until the shaft lobe pushes the hesitator lobe out of its path, moving the rotor ring laterally but also causing some degree of rotation. By moving the rotor ring laterally, the second hesitator lobe is pulled into the path of the shaft lobe, such that a second slow-speed interval is set up. It will be appreciated that, due to the slight rotation of the rotor ring, the slow-speed hesitation events or intervals are incurred in a random or non-uniform manner, thus enhancing the uniformity or the "filling-in" of the circular wetted pattern area.

In another exemplary embodiment, the rotor ring is split into a pair of arcuate segments that are confined to pivoting motion, i.e., the segments are not free to randomly rotate, such that the hesitation or slow-speed intervals are controlled and predictable. Thus, non-round patterns can be designed for wetting irregular areas. For example, if each arcuate segment is provided with a pair of hesitator lobes, one on either side of the segment pivot pin, four relatively short slow-speed intervals are established, separated by four relatively long fast-speed intervals, thus creating a four-legged sprinkling pattern.

In still another embodiment, a 360° rotor ring having a pair of diametrically opposed hesitator lobes is confined in the chamber for lateral movement or translation as the shaft lobe pushes past the hesitator lobes. With this arrangement, a pair of relatively short diametrically opposed slow-speed intervals are separated by a pair of relatively long fast-speed intervals, creating a linear sprinkling pattern.

Accordingly, in one aspect, the invention relates to a sprinkler device comprising: a rotatable shaft having a cam, the cam having a radially outwardly projecting shaft lobe; a water distribution plate supported on one end of the shaft and adapted to be impinged upon by a stream emitted from a nozzle causing the water distribution plate and the shaft to rotate; a hesitator assembly supported on an opposite end of the shaft the assembly including a stationary housing having a sealed chamber at least partially filled with a viscous fluid, the shaft passing through the chamber, with the cam and shaft lobe located within the chamber; and a rotor ring located within the chamber in substantially surrounding relationship to the cam, the rotor ring having two or more inwardly projecting hesitator lobes movable into and out of a path of rotation of the shaft lobe, such that rotation of the shaft and water distribution plate is slowed during intervals when the shaft lobe engages and pushes past the one or more hesitator lobes.

In another aspect, the invention relates to a method of controlling rotation of a water distribution plate supported on a shaft and adapted to rotate by reason of impingement of a stream emitted from a nozzle on grooves formed in the plate, the method comprising: (a) slowing rotation of the shaft under all conditions; and (b) further showing the rotation of the shaft intermittently so as to create intervals of relatively slow and relatively fast rotation and thereby correspondingly increase and decrease, respectively, a radius of throw of the stream.

Exemplary embodiments will now be described in detail in connection with the drawings identified below.

DETAILED DESCRIPTION OF THE DRAWINGS

Figure 1:
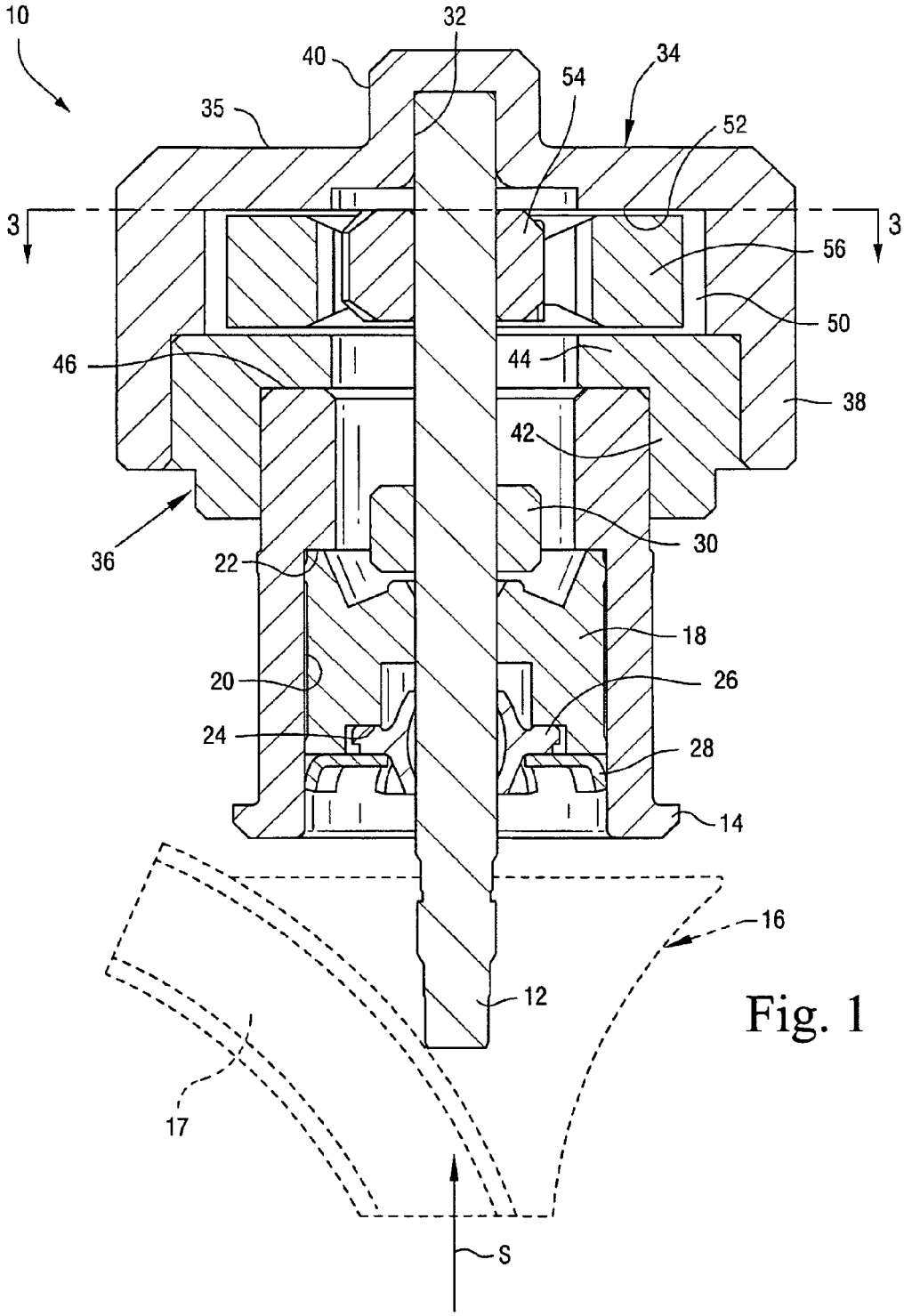
FIG. 1 is a cross section through a viscous hesitator device in accordance with an exemplary embodiment of the invention.
Figure 2:
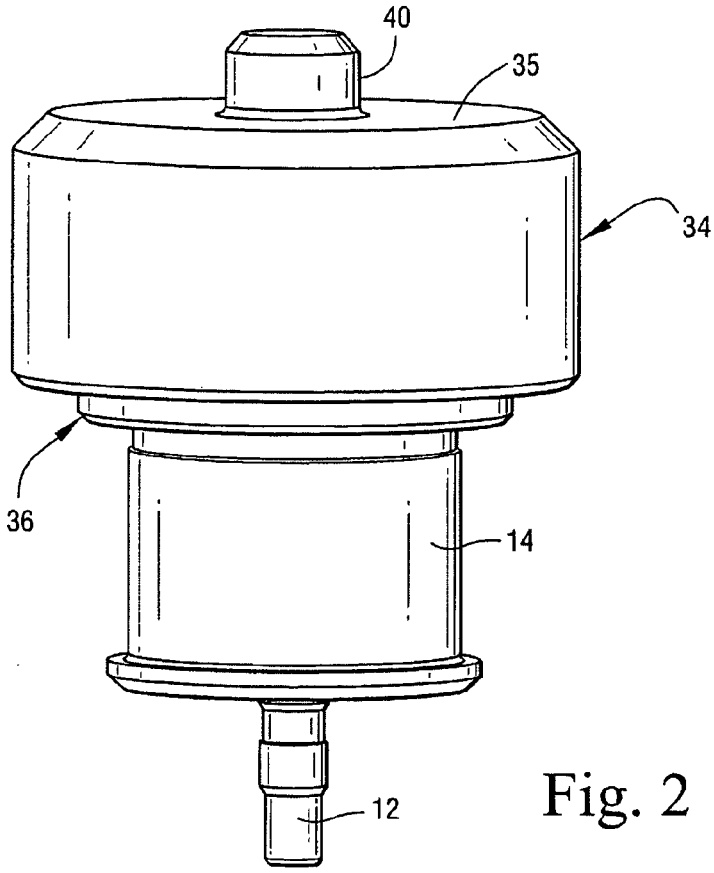
FIG. 2 is a perspective view of the device illustrated in FIG. 1.

Referring initially to FIGS. 1 and 2, a hesitator assembly 10 for incorporation into a rotatable sprinkler includes a shaft 12 secured in a housing 14. The free end of the shaft typically mounts a conventional water distribution plate 16 that substantially radially redirects a vertical stream (indicated by arrow S in FIG. 1) emitted from a nozzle (not shown) in the sprinkler body (also not shown). The plate 16 is formed with one or more grooves 17 that are slightly curved in a circumferential direction so that when a stream emitted from the nozzle impinges on the plate 16, the nozzle stream is redirected substantially radially outwardly into one or more secondary streams that flow along the groove or grooves 17 thereby causing the plate 16 and shaft 12 to rotate.

Shaft 12 is supported within the housing 14 by a bearing 18 that is press-fit within a counterbore 20 formed in the housing. The bearing 18 engages a shoulder 22 formed in the housing and the bearing itself is formed at one end with an annular shoulder 24 that provides a seat for a conventional flexible double-lip seal 26 that engages the shaft and is held in place by a circular retainer 28. A shaft retainer 30 is mounted on the shaft adjacent the opposite end of the bearing 18.

The downstream or remote end of the shaft is received in a blind recess 32 formed in a lid 34 that is attached to a base 36 that, in turn, is attached to the downstream end of the housing 14. The lid 34 is formed with a skirt portion 38 that telescopes over and engages the peripheral side wall of the base 36, and a top surface 35 that joins to a center hub 40 defining the blind recess 32. Similarly, the base 36 is formed with a depending skirt 42 that telescopes over and engages the upper or downstream end of the housing 14. A radial flange 44 engages the upper peripheral edge 46 of the housing.

Within the lid 34, and specifically within a cavity 50 axially between the flange 44 of the base 36 and an underside surface 52 of the top surface 35, a shaft cam 54 is fixed to the shaft 12 for rotation therewith. A substantially ring-shaped rotor 56 surrounds the cam and is otherwise unattached. More specifically, the housing 14, base 36 and lid 34 are configured to form the cavity or chamber 50 between the bearing 18 and the lid 34. The chamber is at least partially if not completely filled with viscous fluid (e.g., silicone). Since the outer diameter (OD) of the rotor ring 56 is greater than the inner diameter (ID) of the base 36, the rotor is confined to chamber 50, but is otherwise free to float on or move within the fluid in the chamber.

It should be noted here that placement of the shaft cam and lobe in the chamber or cavity 50 filled or at least partially filled with viscous fluid will slow the rotation of the shaft and water distribution plate under all conditions, so as to achieve a greater radius of throw as compared to a freely spinning water distribution plate. Thus, reference herein to fast and slow rotation intervals are relative, recognizing that both intervals are at speeds less than would be achieved by a freely spinning water distribution plate.

Figure 3:
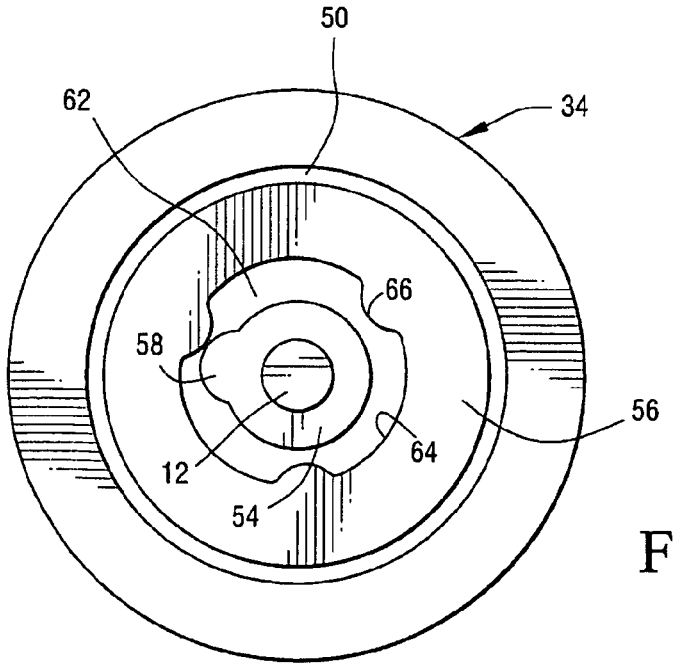
FIG. 3 is a section taken along the line 3-3 of FIG. 1.

The shaft cam 54, as best seen in FIG. 3, is formed with a smoothly curved, convex primary cam lobe 58 (the shaft lobe) projecting radially away from the cam and the shaft center.

The center opening 62 of the rotor ring 56 is defined by an inner diameter surface or edge 64 and is formed with three radially inwardly extending rotor or hesitator lobes 66, equally or randomly spaced about the opening 62.

The interaction between the shaft cam lobe 58 and the hesitator lobes 66 determines the rotational speed of the shaft 12 and hence the water distribution plate 16 (FIG. 1).

More specifically, when a prescribed amount of rotation force is applied to the shaft 12 (via the stream S impinging on grooves 17), the shaft cam 54 will rotate with the shaft within the fluid-filled cavity or chamber 50. The shaft cam 54 has little mass and large clearances which generate a lesser amount of resistance. As the shaft cam 54 rotates, the shaft lobe 58 will come into contact with one of the hesitator lobes 66 on the rotor ring 56. When this takes place, the rotor ring 56 (having a much larger mass and much tighter clearances) will immediately reduce the revolutions per minute of the cam 54 (and hence the shaft 12 and water distribution plate 16) causing a stalling or hesitating effect. The shaft lobe 58 now has to push the hesitator lobe 66 out of the way in order to resume its previous speed.

The rotor ring 56, having multiple hesitator lobes 66 is designed such that, as the shaft cam lobe 58 pushes past one hesitator lobe 66, it pulls the next adjacent hesitator lobe into its path. Moreover, the rotor ring 56 not only moves laterally when engaged by the shaft cam lobe 58, but also rotates slightly in the same direction of rotation as shaft cam 54 and shaft 12. Not being fixed, the rotor ring 56 will thus provide a random stalling or hesitating action due to the periodic but random hesitation of the water distribution plate 16. Stated otherwise, the water distribution plate 16 will rotate through repeating fast and slow angles but at random locations. Varying the outside diameter, overall thickness, the number of and engagement heights of the lobes 66 on the rotor ring 56 will adjust the frequency and length of the stall events. Changing the viscosity of the fluid will also impact the above parameters.

Alternatively, if a random hesitating action is not desired, the locations at which the transition from slow-to-fast, or fast-to-slow-speed can be restricted to a number of desired repeatable positions. This is done by restraining movement of the rotor ring 56 so it can move laterally but cannot rotate when the shaft cam lobe 58 comes into contact with one of the slow-speed or hesitator lobes 66. The rotor ring may be of a one or multiple-piece design, restrained in a fashion so when the shaft cam 54 rotates and shaft lobe 58 comes into contact with a hesitator lobe, the shaft lobe 58 can slowly push the hesitator lobe laterally out of its path, in a slow-speed mode. When it pushes past, the shaft cam 54 (and shaft 12 and water distribution plate 16) returns to a fast-speed mode. This arrangement creates a repeatable (i.e., not a random) slow-to-fast/fast-to-slow-speed interval pattern. By increasing or decreasing the lobe clearances within the fluid-filled housing, or by altering the amount of engagement between the shaft lobe and the hesitator lobe, or both, will result in different repeatable patterns that can be customized for varying application. Changes in those areas will directly affect the start and ending positions of the slow-to-fast/fast-to-slow rotation modes as well as the rotation speed while in the slow-speed mode.

Figure 4:
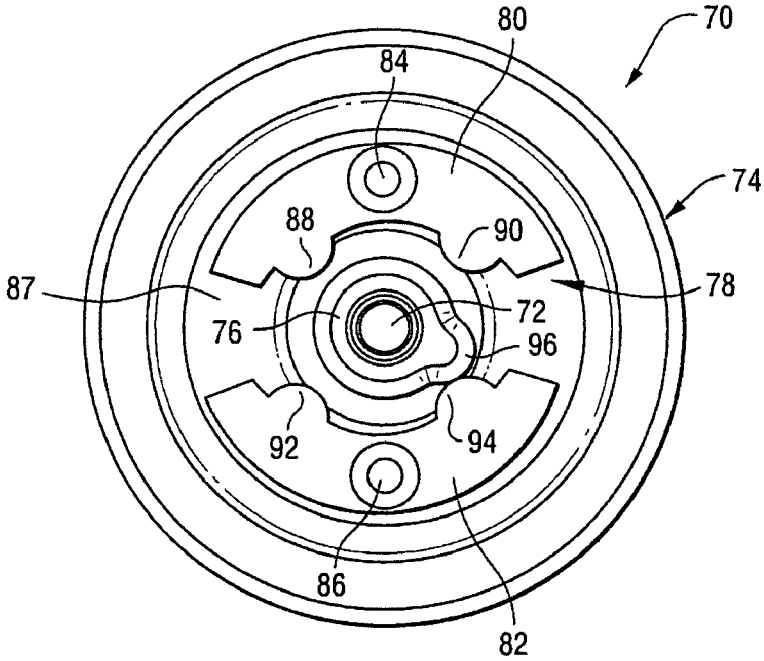
FIG. 4 is a section taken along a section line similar to line 3-3 of FIG. 1, but illustrating an alternative embodiment of the invention.
Figure 5:
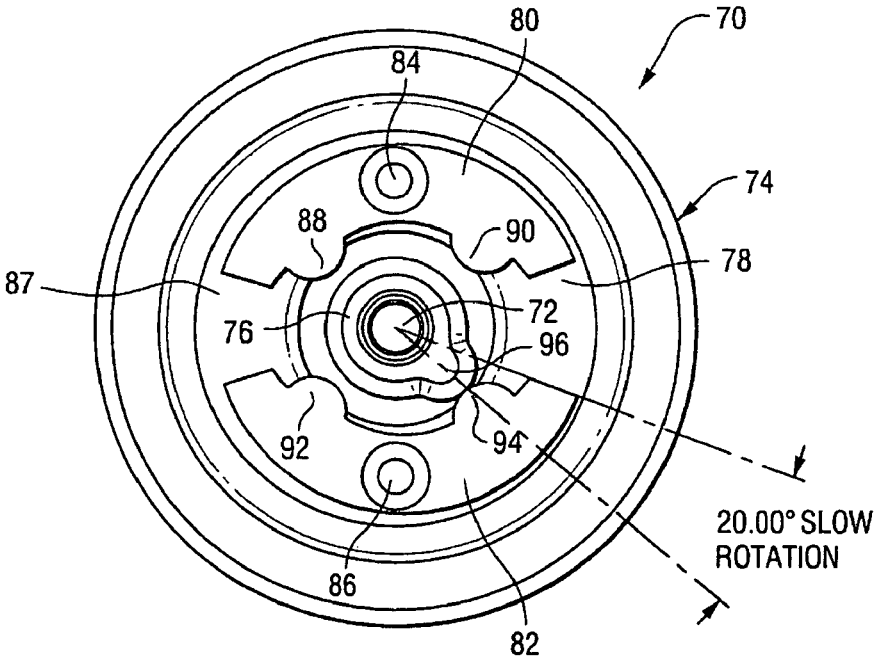
FIG. 5 is a view similar to FIG. 4 but illustrating the rotor cam rotated in a clockwise direction approximately 20°.
Figure 6:
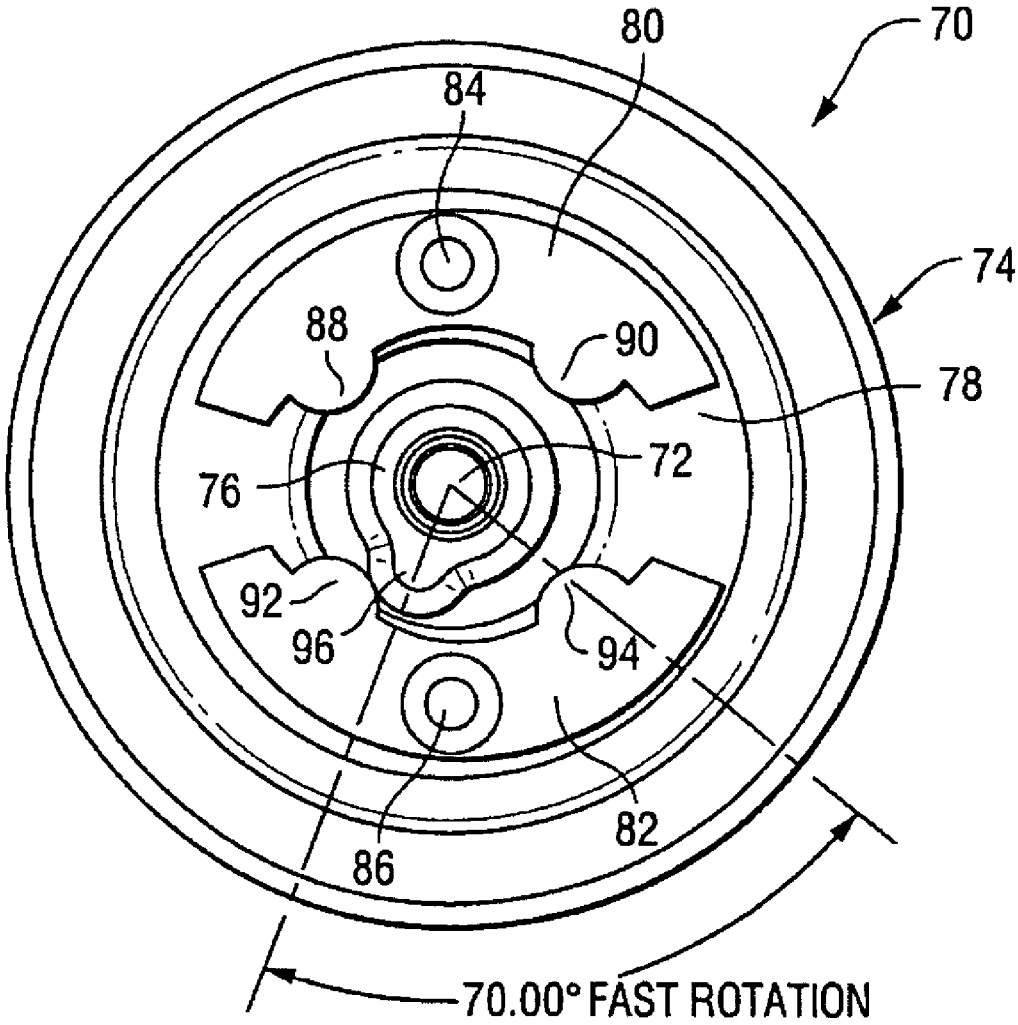
FIG. 6 is a view similar to FIGS. 4 and 5 but illustrating the rotor cam rotated approximately 70° beyond the position shown in FIG. 5.

FIGS. 4-6 illustrate an exemplary fixed-pattern hesitator arrangement. In these views, component parts are generally similar to FIGS. 1 and 2, but with a modified rotor ring. Thus, the hesitator 70 includes a shaft 72 supporting a water distribution plate (not shown but similar to 16 in FIG. 1) at one end thereof, with the opposite end mounted in a housing 74 in a manner similar to that described above. The shaft cam 76 fixed to the shaft 72 is generally similar to cam 54 and is also located in a sealed viscous fluid-filled chamber 78. In this embodiment, however, the rotor ring is formed as two arcuate segments 80, 82, pivotally mounted by pins 84, 86, respectively, to the base 87. Thus, the segments 80, 82 are limited to pivoting motion only within the chamber as described in greater detail below. The arcuate segment 80 includes a pair of radially inwardly projecting hesitator lobes 88, 90 while segment 82 includes a pair of substantially identical inwardly projecting hesitator lobes 92, 94. Note that the lobes 88, 90, 92 and 94 are circumferentially spaced substantially 90° from each other about the shaft 72. The shaft cam 76 is formed with a single radially outwardly projecting shaft lobe 96 that is located so as to successively engage the hesitator lobes 88, 90, 92 and 94 upon rotation of the shaft 72.

With this arrangement, rotation of the shaft 72 and hence the water distribution plate will slow upon engagement of the shaft lobe 96 of cam 76 with anyone of the hesitator lobes 88, 90, 92 and 94. In FIG. 4, the shaft lobe 96 has engaged the hesitator lobe 94, slowing rotation of the shaft 72 and water distribution plate. The slow rotation interval thus starts when the shaft lobe 96 first comes into contact with the hesitator lobe 94, and will continue until the shaft lobe 96 pushes the hesitator lobe 94 out of its path sufficiently to enable the shaft lobe 96 to pass via pivoting action of the segment 82 about pin 86 in a clockwise direction. As indicated in FIG. 5, the slow-speed interval extends through an angle of approximately 20°. In other words, rotation speed will increase as the apex of the shaft lobe 96 passes the apex of hesitator lobe 94 as shown in FIG. 4.

With reference now to FIG. 5, as the shaft lobe 96 pushes past hesitator lobe 94, the pivoting movement of the arcuate segment 82 forces the other hesitator lobe 92 to be positioned in the path of the rotating shaft lobe 96. The degree of rotation from when the shaft lobe 96 pushes past the hesitator lobe 94 to when it comes into contact with the next hesitator lobe 92 may be regarded as the fast-speed interval which, as indicated in FIG. 6, extends through an angle of approximately 70°.

Figure 7:
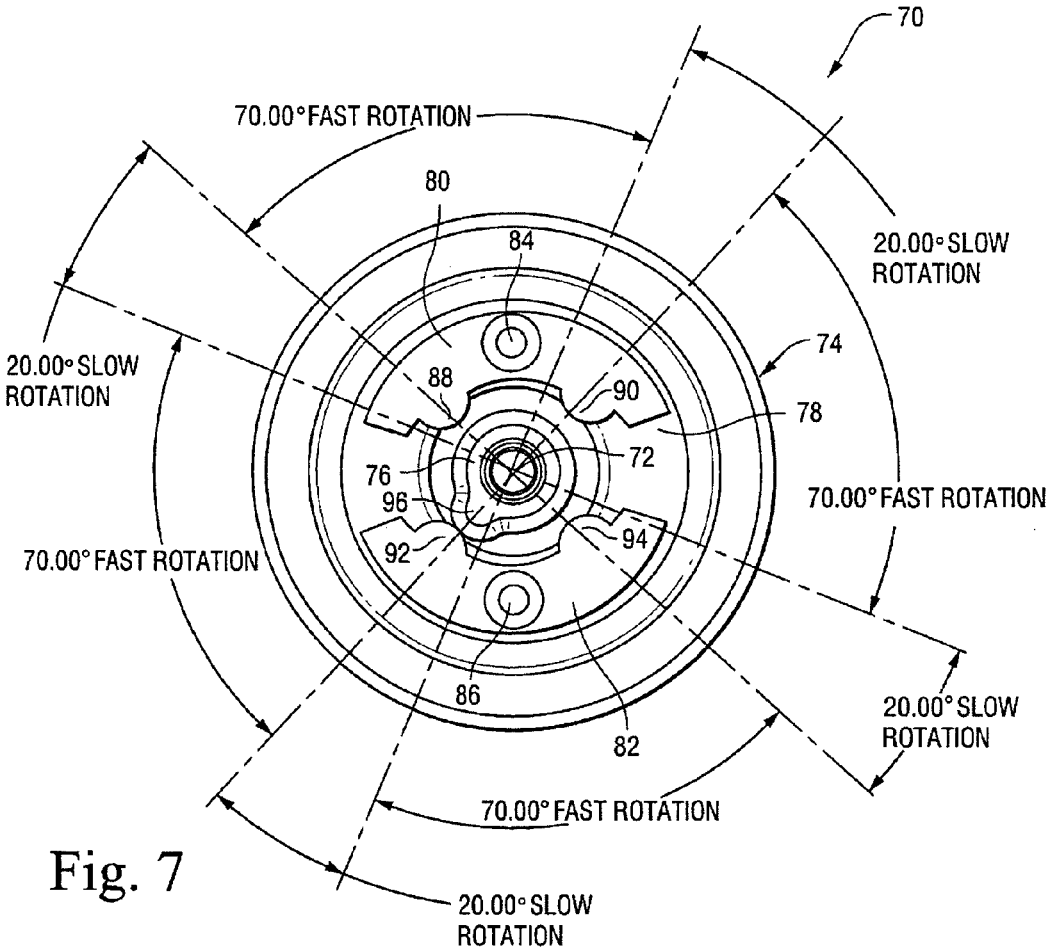
FIG. 7 is a view similar to FIG. 6 but illustrating the rotor rotated 20° past the position shown in FIG. 6, and also, illustrating the various fast and slow rotation intervals spaced about the circumference of the hesitator device.

FIG. 7 shows the shaft lobe 96 further engaged with hesitator lobe 92, and also indicates all of the fixed 20° slow-speed intervals caused by the four hesitator lobes 88, 90, 92 and 94, with 70° fast-speed intervals in between.

Figure 8:
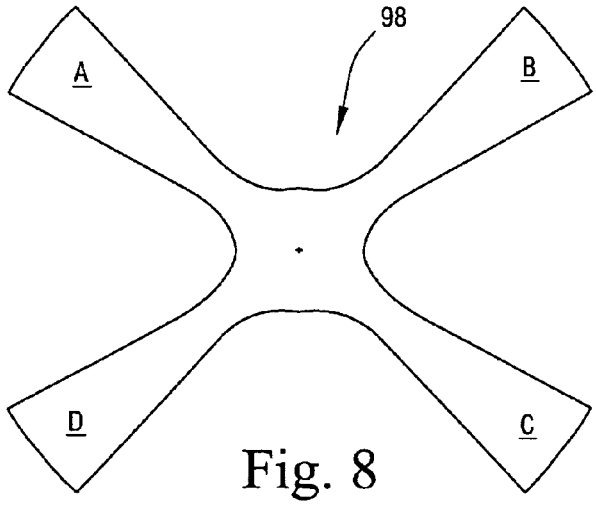
FIG. 8 illustrates a sprinkling pattern achieved by the hesitator device illustrated in FIGS. 4-7.

When the water distribution plate of the sprinkler is in the 20° slow-speed interval, it will throw the water as far as possible (this is its "maximum throw radius"). When it rotates into the 70° fast-speed interval, the throw radius will be greatly reduced. With the described configuration of four hesitator lobes 88, 90, 92 and 94, a four-legged water pattern 98 will form as shown in FIG. 8 as the water distribution plate rotates from fast-to-slow at the four fixed hesitator lobes. The pattern 98 thus includes four extended wetted areas or legs A, B, C and D that correspond to the four 20° slow-speed intervals, whereas areas between the areas A, B, C and D correspond to the four 70° fast-speed intervals. The orientation of all four legs can be adjusted by rotating the sprinkler on its mounting riser. The total degrees of slow and/or fast rotation can also be altered by increasing or decreasing the amount (i.e., duration) of cam/lobe engagement. In addition, the slow rotation speed and the total slow-speed time can be varied by increasing or decreasing the clearances between the moving parts.

Figure 9:
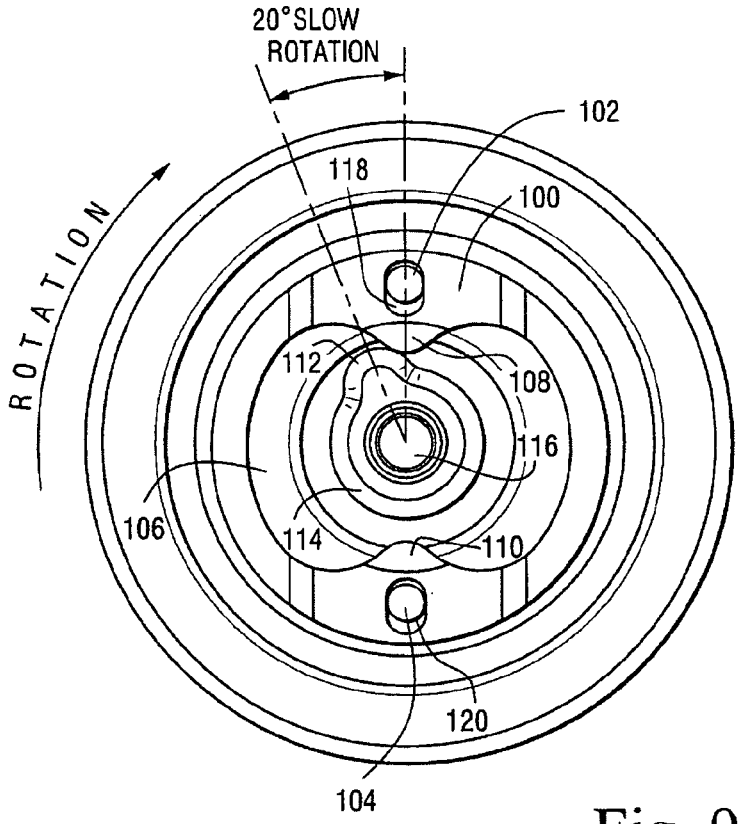
FIG. 9 is a view similar to FIG. 3 but illustrating still another embodiment of the hesitator device.

FIG. 9 discloses another embodiment where, again, the overall configuration of the subassembly is similar to that described in connection with FIGS. 1 and 2, but with a modified rotor ring. In this embodiment, the rotor ring 100 is formed as a 360° annular ring similar to rotor ring 56 shown in FIG. 1, but is confined to lateral movement only by the pins 102, 104 fixed to the base 106. The inner surface of the ring 100 is formed in the shape generally of a figure-eight with a pair of radially inwardly projecting hesitator lobes 108 and 110, moveable into the path of the shaft lobe 112 of the cam 114 fixed to shaft 116. In this case, the slow-speed or slow-rotation interval starts when the shaft lobe 112 first comes into contact with a hesitator lobe, e.g., lobe 108 and the slow rotation will continue until the shaft lobe 112 pushes the hesitator lobe 108 out of its path sufficiently to enable the shaft lobe to pass by. The slow-speed interval depicted in FIG. 9 extends about 20°. Note that as the shaft lobe 112 pushes past the hesitator lobe 108, the rotor ring 100 is forced to move laterally, without rotation, by reason of pins 102, 104 being seated in aligned longitudinal slots 118, 120 formed in the rotor ring 100.

Figure 10:
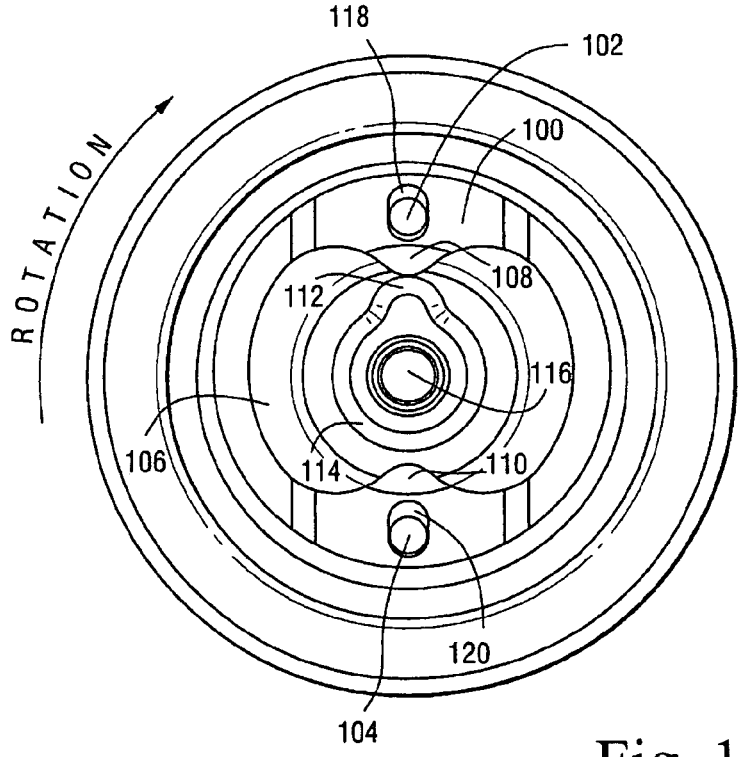
FIG. 10 is a view similar to FIG. 9 but with the rotor rotated approximately 20° from the position shown in FIG. 9.
Figure 11:
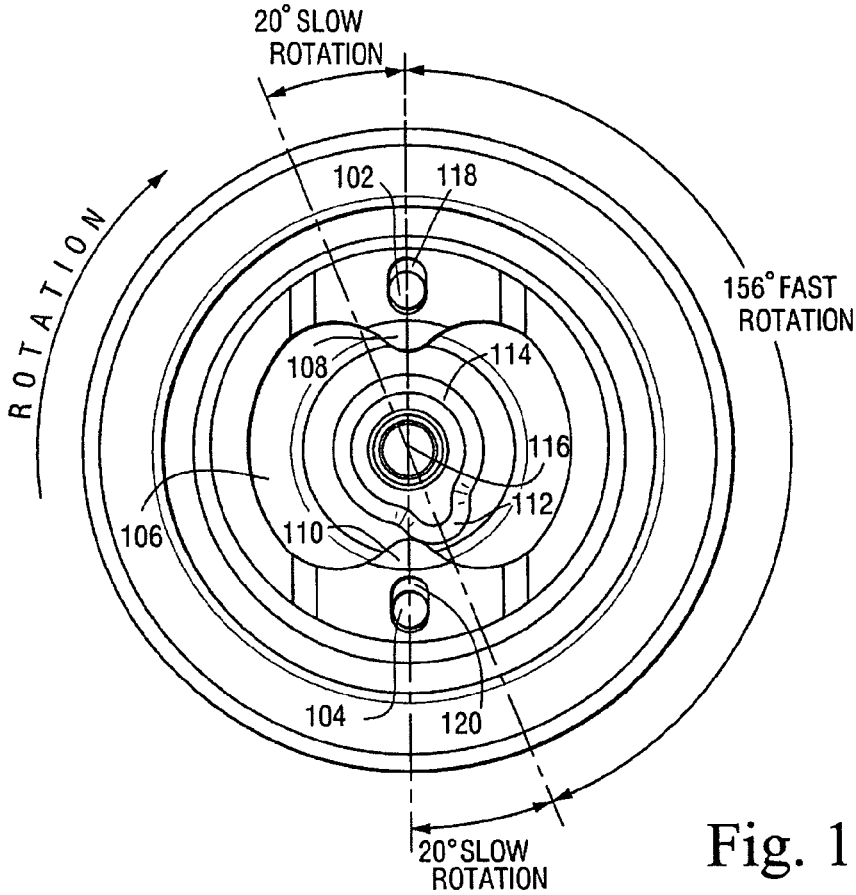
FIG. 11 is a view similar to FIG. 10 but with the rotor rotated approximately 156° from the position illustrated in FIG. 10.

Once the shaft lobe 112 has pushed the hesitator lobe 108 out of its path with the same rotational load applied to the shaft, rotation speed will increase until shaft lobe 112 engages the other hesitator lobe 110 which has been drawn into its path by the lateral movement of the rotor ring. FIG. 10 illustrates the rotor ring 100 moved laterally substantially to its maximum as the shaft lobe 112 and shaft 116 resume a normal fast-speed. FIG. 11 illustrates commencement of the next slow-speed interval of 20° following the fast-speed interval of 156°.

Figure 12:
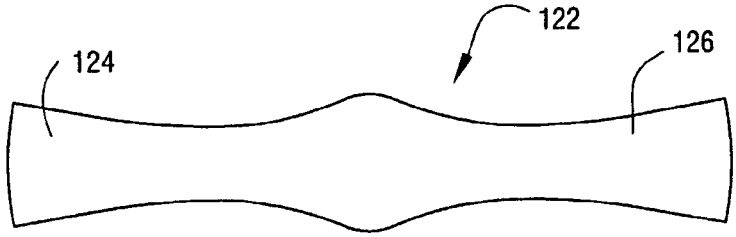
FIG. 12 illustrates a plan view of a sprinkler pattern achieved by use of the hesitator mechanism shown in FIGS. 9-11.

As may be appreciated from FIGS. 9-11, the fixed intervals of 20° slow rotation are diametrically opposed to each other. The sprinkler water distribution plate 16, while in the slow rotation mode, will throw the water as far as possible. The water distribution plate 16 will rotate relatively fast through the 156° angles between the 20° slow-speed intervals, causing the water to be pulled back significantly. This configuration will thus form a long narrow or linear water pattern 122 as shown in FIG. 12, referred to as a strip pattern, with maximum throw evident in the pattern legs 124, 126 corresponding to the opposed 20° slow-speed intervals explained above. The orientation of the pattern is adjustable by rotating the sprinkler on its mounting riser. In addition, the 20° slow-speed angle can again be altered by increasing or decreasing the amount of cam/stop lobe engagement while the slow rotation speed and total slow-speed time can be varied by increasing or decreasing clearances between the mating parts within the viscous-fluid chamber.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A sprinkler device comprising:

a rotatable shaft having a cam, said cam having a radially outwardly projecting shaft lobe;

a water distribution plate supported on one end of the shaft and adapted to be impinged upon by a stream emitted from a nozzle causing said water distribution plate and said shaft to rotate;

a hesitator assembly supported on an opposite end of the shaft said assembly including a stationary housing having a sealed chamber at least partially filled with a viscous fluid, said shaft passing through said chamber, with said cam and shaft lobe located within said chamber; and a rotor ring located within said chamber in substantially surrounding relationship to said cam, said rotor ring having two or more inwardly projecting hesitator lobes movable into and out of a path of rotation of the shaft lobe, such that rotation of said shaft and water distribution plate is slowed during intervals when the shaft lobe engages and pushes past a respective one of said two or more hesitator lobes.

2. The sprinkler device as in claim 1 wherein said two or more hesitator lobes comprises a pair of hesitator lobes and wherein said rotor ring comprises a 360° ring, said pair of hesitator lobes formed on an inside diameter edge of said rotor ring in diametrically opposed relationship.

3. The sprinkler device as in claim 2 wherein said rotor ring is formed with a pair of elongated slots substantially respectively aligned with said pair of hesitator lobes, with a fixed pin received in each of said slots to thereby confine said rotor ring to translation in opposite directions.

4. The sprinkler device as in claim 3 wherein upon successive engagement and disengagement of said shaft lobe with said pair of hesitator lobes, respectively, produce fixed and repeatable intervals of slow and fast rotation of said shaft and said water distribution plate during which radius of throw of the stream is increased and decreased, respectively to thereby produce a substantially linear wetted pattern area.

5. The sprinkler device as in claim 4 wherein said intervals of slow rotation extend over an angle of about 20°.

6. The sprinkler device as in claim 5 wherein said intervals of fast rotation extend over an angle of about 156°.

7. The sprinkler device as in claim 1 wherein said shaft cam and said shaft lobe rotate through said viscous fluid to thereby slow rotation of said water distribution plate.

* * * * *